US006857996B2

(12) United States Patent
Dorer

(10) Patent No.: US 6,857,996 B2
(45) Date of Patent: Feb. 22, 2005

(54) FOLDING DEVICE FOR SHEETS OF PAPER, PLASTIC AND THE LIKE

(75) Inventor: Wilfried Dorer, Donaueschingen (DE)

(73) Assignee: Mathias Bäuerle GmbH, St. Georgen (DE)

( * ) Notice: Subject to any disclaimer, the term of this patent is extended or adjusted under 35 U.S.C. 154(b) by 0 days.

(21) Appl. No.: 10/186,964

(22) Filed: Jun. 26, 2002

(65) Prior Publication Data

US 2003/0001325 A1 Jan. 2, 2003

(30) Foreign Application Priority Data

Jun. 28, 2001 (DE) ..... 101 32 910

(51) Int. Cl.[7] ..... B31F 7/00; B31F 1/00; B31B 1/26

(52) U.S. Cl. ..... 493/419; 493/420; 493/405; 270/32

(58) Field of Search ..... 493/417, 14, 424, 493/419, 420, 158, 125, 405; 270/41, 42, 45, 32

(56) References Cited

U.S. PATENT DOCUMENTS 3,975,009 A * 8/1976 Brown ..... 493/14
4,585,219 A * 4/1986 Lehmann et al. ..... 270/46
4,995,600 A * 2/1991 Kovac et al. ..... 270/45
5,125,633 A * 6/1992 Fecker et al. ..... 270/51
5,242,364 A * 9/1993 Lehmann ..... 493/8
5,322,498 A * 6/1994 Lehmann et al. ..... 493/420
5,871,433 A * 2/1999 Lehmann et al. ..... 493/420
6,224,530 B1 * 5/2001 Okelmann et al. ..... 493/420
6,511,408 B2 * 1/2003 Miki et al. ..... 493/413
2001/0044367 A1 * 11/2001 Belmann et al. ..... 493/417

* cited by examiner

*Primary Examiner*—Andrew H. Hirshfeld
*Assistant Examiner*—Marissa Ferguson
(74) *Attorney, Agent, or Firm*—Gudrun E. Huckett

(57) ABSTRACT

A folding device for sheets of paper or plastic has at least one folding pocket for receiving a sheet to be folded and at least one deflection strip for deflecting a sheet not to be folded. A common holder is provided, and the folding pocket and the deflection strip are secured on the common holder. The common holder has two sidewalls and the folding pocket and the at least one deflection strip are arranged between the two sidewalls. The folding pocket and the deflection strip are adjustable in opposite directions relative to one another. A common drive is provided for the folding pocket and the deflection strip.

29 Claims, 3 Drawing Sheets

Fig.5
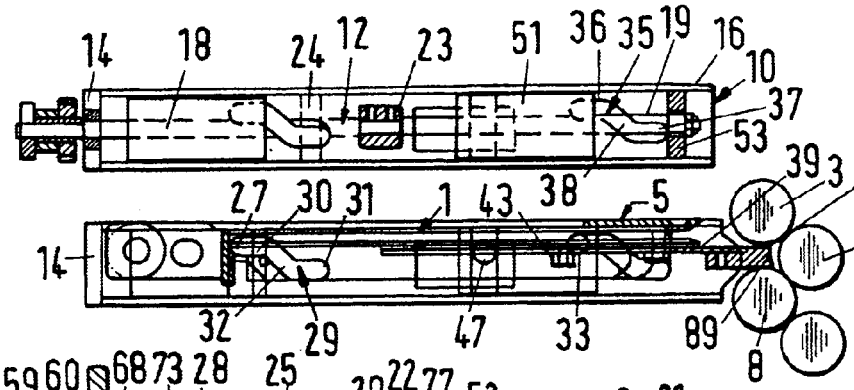
Fig.2
Fig.3
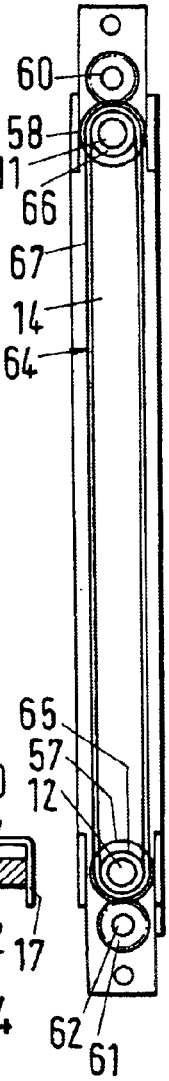
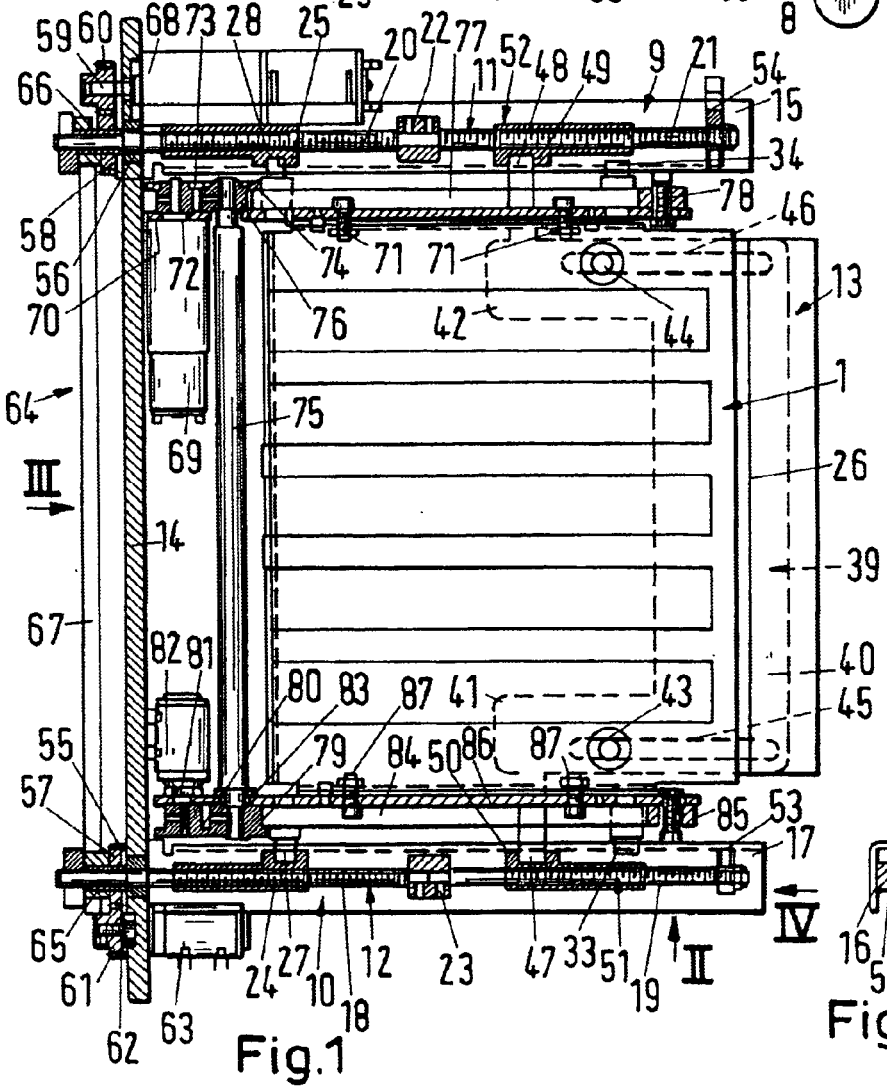
Fig.1
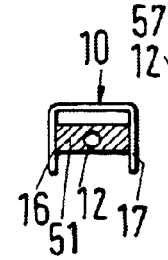
Fig.4

FOLDING DEVICE FOR SHEETS OF PAPER, PLASTIC AND THE LIKE

BACKGROUND OF THE INVENTION

1. Field of the Invention

The invention relates to a folding device for sheets of paper, plastic and the like, comprising at least one folding pocket and at least one deflection strip for the sheet to be folded.

2. Description of the Related Art

In known folding devices, the folding action of the sheet is carried out by means of a folding pocket into which the sheet is transported by means of rollers. However, if it is desired not to fold a sheet while passing through the machine, a deflection strip is substituted for the folding pocket and the sheet, without being folded, is guided by the deflection strip to further transport rollers. The folding pocket and the deflection strip must be manually removed from the folding device and manually inserted, respectively, depending on whether the sheet is to be folded or not. Such an operation is cumbersome and time-consuming.

SUMMARY OF THE INVENTION

It is an object of the present invention to configure the folding device of the aforementioned kind such that the sheets can be folded in a simple way or can be transported without being folded to the next transport rollers.

In accordance with the present invention, this is achieved in that the folding pocket and the deflection strip are secured on a common holder.

In the folding device according to the invention, the folding pocket and the deflection strip are arranged on the common holder. Accordingly, the two units must not be manually removed and inserted, respectively, in a cumbersome way so that the sheets passing through the machine can be folded as required or can be transported farther without being folded.

In another embodiment of the invention, the folding pocket and the deflection strip are configured such that they can be moved relative to one another in opposite directions. When the folding pocket is moved into its operating position, the deflection strip is returned from its operating position into a rest position. This enables a very simple adjustment of the folding device.

As a result of the configuration according to the invention, an automated operation is ensured so that the use of the folding device enables a very high output.

BRIEF DESCRIPTION OF THE DRAWING

In the drawing:

FIG. 1 shows partially in section as well as in a plan view a folding device according to the invention;

FIG. 2 is a view in the direction of arrow II of FIG. 1;

FIG. 3 is a view in the direction of arrow III of FIG. 1;

FIG. 4 is a view in the direction of arrow IV of FIG. 1;

FIG. 5 is a view similar to FIG. 2;

DESCRIPTION OF THE PREFERRED EMBODIMENTS

Figure 11:
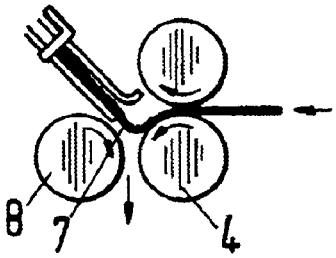
FIG. 11 show schematically a third step of the process of folding a sheet by means of the folding pocket.
Figure 12:
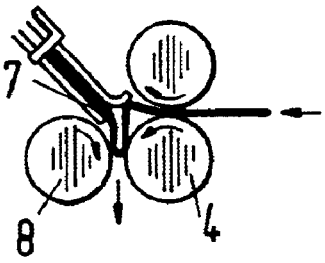
FIG. 12 shows schematically a fourth step of the process of folding a sheet by means of the folding pocket.
Figure 13:
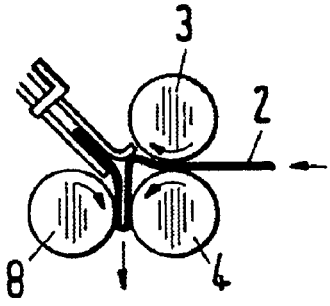
FIG. 13 shows schematically a fifth step of the process of folding a sheet by means of the folding pocket.

The folding device serves for folding a sheet of paper, plastic, or the like by means of a folding pocket 1. FIGS. 9 through 13 show schematically the basic folding process. A sheet 2 is fed between two rollers 3, 4 which are driven in opposite directions as indicated by the illustrated arrows. By means of the two rollers 3, 4, the sheet 2 is transported to the folding pocket 1. The sheet 2 is inserted into the folding pocket 1 and is transported in it to the stop 5 where the sheet impacts with its leading edge 6. The rollers 3, 4 continue to be rotationally driven even after the sheet 2 has impacted on the stop 5. In this way, the sheet 2 is shoved to form a loop 7 (FIG. 11) which reaches the gap between the two rollers 8, 4 (FIG. 12). The two rollers 4, 8 form oppositely rotating folding rollers which grip the loop 7 (FIG. 12). When the folded sheet 2 passes through the roller gap between the two folding rollers 4, 8, the folding action to form the fold is realized. The sheet 2 is then transported in the folded state by means of the two rollers 4, 8 and the sheet 2 is pulled out of the folding pocket 1 (FIG. 13). The position of the adjustable stop 5 determines the location where the fold in the sheet 2 is to formed, i.e., the folding length.

The folding device has two parallel extending sidewalls 9, 10 which are formed by a U-shaped profiled member (FIG. 4), respectively. These two profiled walls 9, 10 are open to the exterior and receive a drive spindle 11, 12, respectively. By means of the drive spindles 11, 12 the folding pocket 1 as well as the deflection strip 13 are moveable from a retracted rest position into an operating or working position (FIGS. 2 and 6) projecting past the sidewalls 9, 10 in a way to be described in the following. The folding pocket 1 and the deflection strip 13 are simultaneously adjustable by means of the working spindles 11, 12 in opposite directions. When the deflection strip 13 is returned from the working or operating position illustrated in FIGS. 1 and 2, the folding pocket 1 is moved at the same time out of the retracted rest position illustrated in FIG. 2 into the operating position according to FIGS. 6 and 7.

The two sidewalls 9, 10 are connected with one another at one end by a transverse wall 14. The U-shaped cross-sectional configuration of the sidewalls 9, 10 results in high stiffness of these sidewalls. The two drive spindle 11, 12 are arranged in a protected manner between the parallel extending legs 16 and 15, 17 of the sidewalls 9, 10. In order to drive the folding pocket 1 and the deflection strip 13 in opposite directions, the drive spindle 11, 12 have two threaded sections 18, 19 and 20, 21, respectively. The threaded sections 18 and 19 as well as 20 and 21 have opposite pitch. For example, the threaded sections 18 and 20 have a right-hand thread while the threaded sections 19 and 21 have a left-hand thread.

In the shown embodiment, the two drive spindles 11, 12 are comprised of two spindle parts which are connected fixedly with one another by a coupling member 22, 23. They are positioned between the legs 15, 16, 17 of the sidewalls 9, 10. Since the drive spindles 11, 12 are comprised of two spindle parts, differently oriented threads can be produced easily thereon.

A driver 24, 25 is positioned on the threaded sections 18, 20, respectively, and is connected to the folding pocket 1. The folding pocket 1 is provided at its end facing away from the insertion end 26 for the sheets 2 with transversely projecting bolts 27, 28 which project perpendicularly from the edges of the folding pocket 1 positioned adjacent to the sidewalls 9, 10. The bolts 27, 28 are aligned with one another and engage a connecting link 29 in the sidewalls 9, 10 in a positive-locking way, respectively, so as to form sliding blocks of the connecting link 29. As illustrated in FIG. 2, the two aligned connecting links 29 have upper and lower straight guide sections 30, 31. These guide sections 30, 31 are connected to one another by a slanted intermediate guide section 32. In the rest position of the folding pocket 1 illustrated in FIGS. 1 and 2, the bolts 27, 28 are positioned in the guide section 30 which is provided at a minimal spacing from the top leg 16 of the sidewalls 9, 10.

In the same way, near the insertion opening 26 additional bolts 33, 34 are provided on the longitudinal sides of the folding pocket 1 and project transversely from the folding pocket 1. In contrast to the bolts 27, 28, they are not connected with a driver. The bolts 33, 34 engage further connecting links 35 which are provided in the sidewalls 9, 10 and form sliding blocks of the connecting links 35. The connecting links 35 are of the same configuration as the connecting links 29 and have also two guide sections 36, 37 positioned at different levels which are connected to one another by a slantedly positioned intermediate guide section 38. In the retracted rest position of the folding pocket 1, the bolts 33, 34 are positioned in the guide section 36 which is positioned at a minimal spacing from the top leg 16 of the sidewalls 9 and 10.

Figure 7:
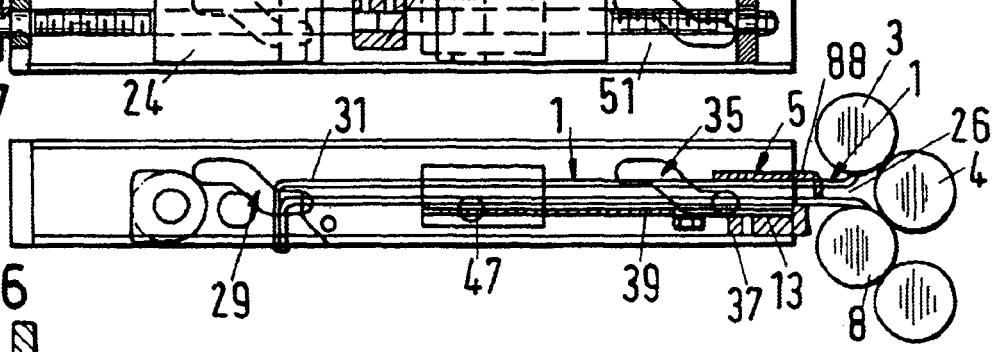
FIG. 7 is a view in the direction of arrow VII of FIG. 6.

Since the folding pocket 1 is guided by two bolts 27, 28; 33, 34 on both longitudinal edges in a positive-locking way in the connecting links 29, 35, the folding pocket 1 can be moved in a direction of displacement reliably from the retracted rest position (FIG. 2), in which it does not project past the sidewalls 9, 10, into the working position or operating position according to FIG. 7 in which it project past the sidewalls 9, 10. When moving from the rest position into the operating position, the folding pocket 1 is not only moved in its longitudinal direction but, because of the connecting links 29, 35, also vertically in a translatory way.

The deflection strip 13 is fastened on the underside of a flat support 39 which is secured, in turn, on the underside of the folding pocket 1. As illustrated in FIG. 1, the support 39 is U-shaped with a narrow stay 40 and two parallel extending legs 41, 42 which are fastened by means of a threaded bolt 43, 44 or the like on the folding pocket 1. The threaded bolts 43, 44 engage the folding pocket 1 through longitudinal slots 45, 46 (FIG. 1) forming guides for the guide members in the form of the threaded bolts 43, 44. The longitudinal slots 45, 46 extend in the direction of displacement of the folding pocket 1 and the deflection strip 13. Because of the longitudinal slots 45, 46, the deflection strip 13 can be moved relative to the folding pocket 1.

Near the free ends of the legs 41, 42, bolts 47, 48 project perpendicularly from the legs 41, 42 of the support 39 and are aligned with one another. They engage the guide 49, 50 extending perpendicularly to the movement direction. The guide 49, 50 is provided on a driver 51, 52, respectively. The drivers 51, 52 are positioned on the threaded sections 19 and 21 of the drive spindles 11, 12. The guides 49, 50 of the drivers 51, 52 extend between the two legs 16, 17; 16, 15 of the sidewalls 9, 10, respectively.

The two drive spindles 11, 12 are rotatably supported with their ends, leading in the direction of extension of the folding pocket 1, in bearings 53, 54 arranged in the sidewalls 9, 10. The trailing ends of the drive spindles 11, 12 in the direction of extension of the folding pocket 1 project past the transverse wall 14. They are rotatably supported in bearings 55, 56 in the transverse wall 14. On the projecting end of the drive spindles 11, 12, gear wheels 57, 58 are fixedly positioned. The gear wheel 58 engages a gear wheel 60 fixedly positioned on the motor shaft 59 while the gear wheel 57 meshes with a gear wheel 61 that is fixedly connected on the shaft 62 of an encoder 63.

Both drive spindles 11, 12 are connected to one another by a belt drive 64 which comprises the two pulleys 65, 66 seated fixedly on the drive spindles and connected with one another by a belt 67, preferably, a toothed belt. An electric motor 68 is fastened on an end of the transverse wall 14 projecting past the sidewall 9.

In order to move the folding pocket 1 from the rest position into its operating position and back, the electric motor 68 is switched on. Via the gear system 58, 61 it drives the drive spindle 11 in rotation. By means of the belt drive 64 the drive spindle 12 is also driven in rotation. Depending on the rotational direction of the drive spindles 11, 12, the drivers 24, 25; 51, 52 are moved in opposite directions relative to one another as a result of the oppositely oriented threads of the drive spindles 11, 12. When the folding pocket 1 is in the rest position illustrated in FIGS. 1 and 5, the electric motor 68 is actuated such that the drivers 24, 25 for the folding pocket 1 are moved to the right in FIG. 5 and, accordingly, the drivers 51, 52 are moved to the left on the working spindles 11, 12. The bolts 27, 28, 33, 34 are moved in this connection out of the guide sections 27, 36 via the slanted intermediate guide sections 32, 38 into the guide sections 31, 37 of the connecting link 29, 35. This has the result that the folding pocket 1 during this extension movement moves away from the top leg 16 of the sidewalls 9,10 and moves in the direction toward the oppositely positioned leg 15 or 17. FIG. 7 shows the folding pocket 1 in its operating position in which the bolts 27, 28; 33, 34 are positioned in the guide sections 31, 37 of the connecting links 29, 35.

The deflection strip 13 is connected by means of the support 39 with the folding pocket 1; the support 39 is moved together with the folding pocket 1 by a translatory movement transversely to the legs 15, 16, 17 of the sidewalls 9, 10. At the same time, it is retracted by means of the two drivers 51, 52. As a result of the longitudinal slots 45, 46 in the legs 41, 42, the support 39 can be moved back relative to the folding pocket 1 counter to the extension direction (direction of displacement) of the folding pocket 1. Since the support 39 engages the guides 49, 50 of the drivers 51, 52 by means of bolts 47, 48 perpendicularly to the displacement direction, the support 39 can follow the movement of the folding pocket 1 transverse to the extension direction. By means of the guides 49, 50 and the longitudinal slots 45, 46, it is thus ensured that the support 39 and also the deflection strip 13 connected thereto can be moved not only in the extension direction but also perpendicularly thereto in the vertical direction.

The extension movement of the folding pocket 1 into the working or operating position is advantageously terminated when the bolts 27, 28; 33, 34 impact on the ends of the guide sections 31, 37 of the connecting links 29, 35.

The displacement movement is measured by the encoder 63 with which the adjustments relative to the displacement path of the folding pocket 1 and the deflection strip 13 can be stored in a memory device.

Figure 8:
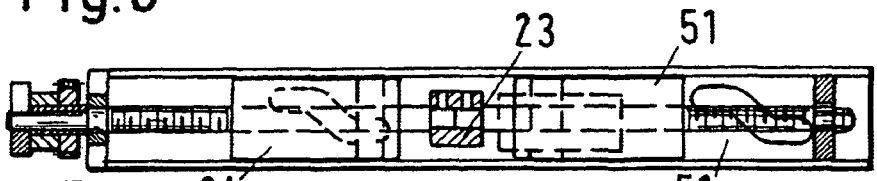
FIG. 8 is a view similar to FIG. 7 without the folding pocket.
Figure 6:
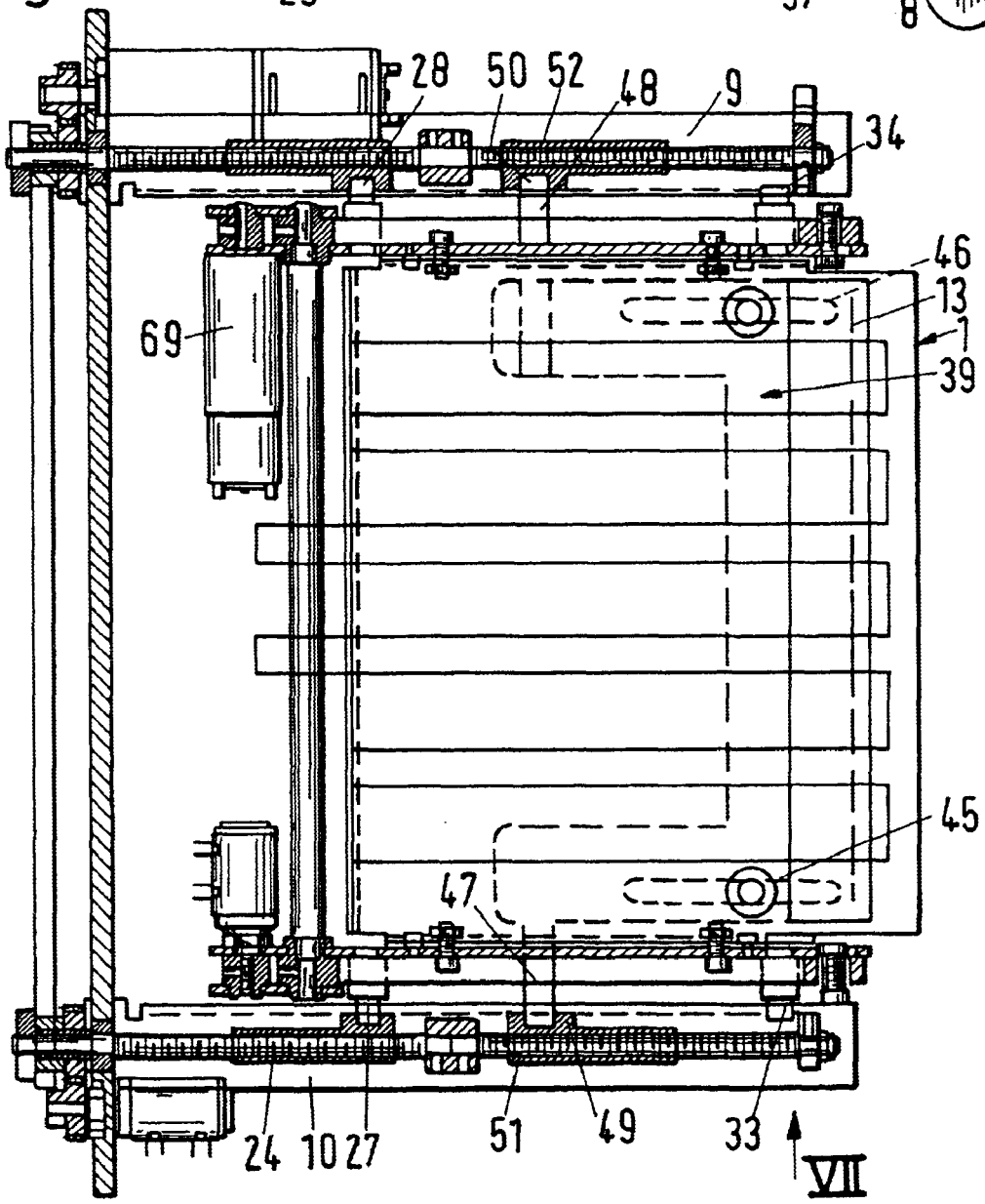
FIG. 6 is a plan view onto the folding device according to FIG. 1 in which the folding pocket is in its operating position.
Figure 9:
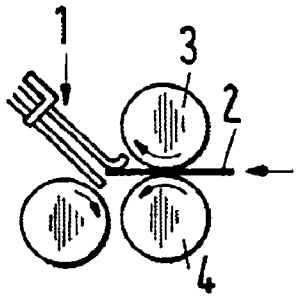
FIG. 9 shows schematically a first step of the process of folding a sheet by means of the folding pocket.
Figure 10:
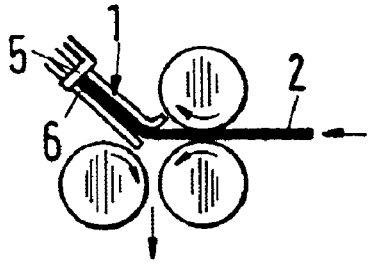
FIG. 10 show schematically a second step of the process of folding a sheet by means of the folding pocket.

When the folding pocket 1 is extended into its working position and the deflection strip 13 is retracted into its rest position (FIGS. 6 and 7), the drivers 24, 25; 51, 52 on the working spindles 11, 12 have the smallest spacing relative to one another (FIGS. 6 and 8). In the rest position, the deflection strip 13 projects slightly past the sidewalls 9, 10 and is covered by the folding pocket 1 (FIG. 7).

The drivers 24, 25; 51, 52, as illustrated in FIGS. 5 and 8, are of a parallelepipedal shape in a side view. The drivers rest against the facing inner sides of the legs 15, 16, 17 of the sidewalls 9, 10 so that they can be reliably moved by means of the rotational movement of the drive spindles 11, 12. Moreover, the followers 24, 25, 51, 52 are positioned so as to be protected between the legs 15 to 17 of the sidewalls 9, 10.

In order to be able to adjust the folding edge, the stop means with the stop 5 (FIGS. 2 and 7) is continuously adjustable. The stop means has an adjusting mechanism for this purpose to be described in the following. A drive motor 69 (FIG. 1) preferably, an electric motor, is fastened on a support 70 which is connected to the folding pocket 1 and projects past the end of the folding pocket 1 facing away from the insertion opening 26. The support 70, as illustrated in FIG. 1, is attached by means of screws 71 to the longitudinal edge of the folding pocket 1 neighboring the sidewall 9. On the motor shaft 72, a gear wheel 73 is fixedly mounted which engages the gear wheel 74 which is fixedly mounted on a shaft 75. The shaft 75 is positioned parallel to the transverse wall 14 in the area between the transverse wall 14 and the neighboring end of the folding pocket 1. On one end of the shaft 75 a pulley 76 is fixedly mounted which is connected drivingly by means of the belt 77 with a pulley 78. The pulley 78 is supported rotatably on the outer side of the support 70 on the end which neighbors the insertion opening 26. The belt drive as well as the gear system 73, 74 are positioned in the area between the folding pocket 1 and the neighboring sidewall 9. In this way, the belt drive is arranged in a protected way.

The end of the shaft 75 adjacent to the sidewall 10 also supports fixedly a gear wheel 79 which meshes with a gear wheel 80 that is fixedly mounted on a shaft 81 of an encoder 82. The encoder 82 is fastened on the side of the transverse wall 14 facing the folding pocket 1. The shaft 75 supports on this end fixedly a pulley 83 which is in driving connection by means of a belt 84 with a belt pulley 85. The shaft 75 and the pulley 85 are supported on an additional support 86 which is connected by screws 87 with a neighboring longitudinal edge of the folding pocket 1. The support 86 is positioned parallel to the support 70. The belt drive 83 to 85 and the gear system 79, 80 are positioned in the area between the sidewall 10 and the folding pocket 1. In order to be able to adjust the stop 5, the motor 69 is switched on. The shaft 75 is rotated in the desired direction via the gear system. By means of the encoder 82, the adjusting path can be reliably detected or measured and stored in a memory so that the precise adjustment position of the stop 5 can be reached with high precision at any time. The stop 5, which extends perpendicularly to the sidewalls 9, 10 and is positioned in the feed path of the sheet 2 within the folding pocket 1, is connected with the belts 72, 84 so that the stop 5 can be adjusted in the desired position relative to the folding pocket 1 via the described drive connection. The stop 5 is advantageously sheet-or plate-shaped and provided at the end facing the insertion opening 26 of the folding pocket 1 with an advantageously rectangularly positioned stop member 88 (FIGS. 2 and 7) which projects into the feed path of the sheet 2 to be folded. The stop 5 can be adjusted independent of the folding pocket 1.

FIGS. 1 and 2 show a position in which the folding pocket 1 is returned into its rest position while the deflection strip 13 is in its operating position. It is pushed to such an extent past the sidewalls 9, 10 that it is located in the area between the two rollers 3 and 4. The sheet (not illustrated) which has been supplied by means of the rollers 3 and 4 reaches with its leading edge in the feeding direction a concavely curved end face 89 of the deflection strip 13. In this way, the sheet is deflected into the roller gap between the rollers 4 and 8 so that it is transported past the folding device. In this case, this sheet is not folded but transported to further processing stations.

However, when the supplied sheet 2 is to be folded, the folding pocket 1 is moved from its rest position into the operating position in the way described above. It is lowered and at the same time advanced into this operating position by means of the connecting links 29, 35. Simultaneously, the deflection strip 13 is retracted by means of the drivers 51, 52 into the rest position illustrated in FIGS. 6 and 7. The folding pocket 1 is now positioned in the area between the rollers 3, 8 (FIG. 7). The sheet (not illustrated in FIG. 7) fed by the roller gap between the rollers 3, 4 reaches via the insertion opening 26 the folding pocket 1. In the folding pocket 1, the sheet is transported to the stop at the stop member 88. Since the two rollers 3, 4 are continued to be driven even after the sheet has impacted on the stop member 88, a downwardly suspended loop 7 is formed by the sheet 2 (FIGS. 11 through 13). The loop 7 reaches the area between the two rollers 4, 8. In the end, the loop 7 is gripped in the way described above by the two rollers 4, 8. Upon passing through the rollers, the fold is formed in the sheet 2. The folded sheet 2, as has been described in connection with FIGS. 9 through 13, is pulled out of the folding pocket 1.

The folding pocket 1 and the stop 5 are of a configuration known in the art so that these parts of the folding device need not be explained in further detail.

The folding device enables automated operation. Depending on the folding process, the folding device is advantageously controlled by a computer which moves the folding pocket 1 or the deflection strip 13 into the working position, respectively. This movement can be carried out fully automated and within a very short period of time so that a great output can be achieved with the folding device according to the invention. The folding pocket 1 and the deflection strip 13 are secured on a common frame which is formed by the sidewalls 9, 10 and the transverse wall 14 connecting the sidewalls 9, 10. The folding device is of a small size and requires only minimal space for its installation. Since the folding pocket 1 and the deflection strip 13 can be moved simultaneously and in opposite directions, the position change of these two components is easy to carry out and can be performed within a short period of time. The folding device can be configured to be very small and is suitable particularly for machines in which the rollers 3, 4, 8 have a very small diameter which can be, for example, within the magnitude of only 20 to 25 mm. Despite the small roller diameter, the folding device exhibits a high stiffness of the folding pocket 1 and of the deflection strip 13. Since the adjusting position of the stop 5 is detected by an encoder 82, the stop 5 can also be automatically adjusted; the respective position of the stop 5 can be stored in a memory so that the desired position of the stop 5 can be reached at any time with great precision. In this way, it is no longer necessary to perform trial runs in order to determine the correct position of the fold within the sheet 2.

In a simple configuration of the inventive folding device, a manual drive can be provided instead of the drive motor(s) 68 and/or 69, for example, in the form of a crank drive where the respective gear wheel 60, 73 is manually rotated by means of a crank.

While specific embodiments of the invention have been shown and described in detail to illustrate the inventive principles, it will be understood that the invention may be embodied otherwise without departing from such principles.

What is claimed is:

1. A folding device for sheets of paper or plastic, the folding device comprising at least one folding pocket for receiving a sheet to be folded and at least one deflection strip for deflecting a sheet not to be folded, further comprising a common holder, wherein the at least one folding pocket and the at least one deflection strip are moveably connected to the common holder, and wherein the at least one folding pocket and the at least one deflection strip are moveable in opposite directions relative to one another and relative to the common holder.

2. The folding device according to claim 1, wherein the common holder has two sidewalls and wherein the at least one folding pocket and the at least one deflection strip are connected to the two sidewalls so as to be moveable relative one another.

3. The folding device according to claim 2, wherein the two sidewalls are profiled members.

4. The folding device according to claim 3, wherein the profiled members have a U-shaped cross-section.

5. The folding device according to claim 1, further comprising a common drive, wherein the at least one folding pocket and the at least one deflection strip are connected to the common drive.

6. The folding device according to claim 5, wherein the common drive comprises at least one drive spindle.

7. The folding device according to claim 6, wherein the at least one drive spindle is connected to the at least one folding pocket, or to the at least one deflection strip, or to the at least one folding pocket and the at least one deflection strip.

8. The folding device according to claim 6, wherein the at least one drive spindle comprises thread sections with oppositely oriented pitch.

9. The folding device according to claim 6, wherein the common drive comprises a motor with a motor shaft and a gear system, wherein the at least one drive spindle is connected drivingly to the motor shaft by the gear system.

10. The folding device according to claim 6, wherein the common drive further comprises a belt drive, wherein two of the drive spindles are provided and connected drivingly with one another by the belt drive.

11. The folding device according to claim 10, further comprising an encoder connected to one of the two drive spindles by a gear.

12. The folding device according to claim 8, wherein the at least one folding pocket has a first driver cooperating with a first one of the threaded sections.

13. The folding device according to claim 12, wherein the at least one deflection strip has a second driver cooperating with a second one of the threaded sections.

14. The folding device according to claim 13, wherein the at least one folding pocket is movable in a direction of displacement from a retracted rest position into a working position and back into the retracted rest position.

15. The folding device according to claim 14, wherein the at least one deflection strip is movable in a direction of displacement from a retracted rest position into an operating position and back into the retracted rest position.

16. The folding device according to claim 15, further comprising a support moveable in the direction of displacement of the at least one folding pocket relative to the at least one folding pocket, wherein the at least one deflection strip is connected to the support.

17. The folding device according to claim 16, wherein the folding pocket has at least one guide extending in the direction of displacement of the at least one deflection strip and wherein the at least one deflection strip has at least one guide member engaging the at least one guide.

18. The folding device according to claim 17, wherein the at least one guide is a longitudinal slot provided in the at least one folding pocket.

19. The folding device according to claim 15, wherein the at least one deflection strip is guided transversely to the direction of displacement in at least one guide.

20. The folding device according to claim 19, wherein the at least one guide is provided on the at least one second driver of the at least one deflection strip.

21. The folding device according to claim 14, wherein the at least one folding pocket is moveable transversely to the direction of displacement when being moved from the retracted rest position into the operating position and back into the retracted rest position.

22. The folding device according to claim 21, wherein at least one of the two sidewalls has at least one connecting link and wherein the at least one folding pocket has sliding blocks guided in the at least one connecting link.

23. The folding device according to claim 14, wherein the at least one deflection strip is coupled with the at least one folding pocket.

24. The folding device according to claim 8, wherein the at least one spindle is comprised of separate spindles part connected fixedly with one another by coupling members, wherein the threaded sections with oppositely oriented pitch are provided on the separate spindle parts, respectively.

25. The folding device, according to claim 1, wherein the at least one folding pocket has a stop means with a stop for adjusting a folding length of a sheet, wherein the stop means is configured to be automatically adjustable to a position determining the folding length.

26. A folding device for sheets of paper or plastic, the folding device comprising at least one folding pocket for receiving a sheet to be folded and at least one deflection strip for deflecting a sheet not to be folded, further comprising a common holder, wherein the at least one folding pocket and the at least one deflection strip are secured on the common holder;

wherein the at least one folding pocket and the at least one deflection strip are moveable in opposite directions relative to one another;

further comprising a common drive, wherein the at least one folding pocket and the at least one deflection strip are connected to the common drive;

wherein the common drive comprises at least one drive spindle;

wherein the at least one folding pocket has a first driver cooperating with a first one of the threaded sections;

wherein the at least one deflection strip has a second driver cooperating with a second one of the threaded sections;

wherein the at least one folding pocket is movable in a direction of displacement from a retracted rest position into a working position and back into the retracted rest position;

wherein the at least one folding pocket is moveable transversely to the direction of displacement when being moved from the retracted rest position into the operating position and back into the retracted rest position;

wherein at least one of the two sidewalls has at least one connecting link and wherein the at least one folding pocket has sliding blocks guided in at least one connecting link;

wherein the at least one connecting link has two first guide sections staggered relative to one another transversely to the direction of displacement of the at least one folding pocket, wherein the at least one connecting link has a slanted intermediate second guide section connecting the two first guide sections with one another.

27. A folding device for sheets of paper or plastic, the folding device comprising at least one folding pocket for receiving a sheet to be folded and at least one deflection strip for deflecting a sheet not to be folded, further comprising a common holder, wherein the at least one folding pocket and the at least one deflection strip are secured on the common holder;

wherein the at least one folding pocket has a stop means with a stop for adjusting a folding length of a sheet, wherein the stop means is configured to be automatically adjustable to a position determining the folding length;

wherein the stop means comprises at least one endless drive for adjusting the position determining the folding length.

28. The folding device according to claim 27, wherein two of the endless drives are provided and have a common shaft for commonly driving the two endless drives.

29. The folding device according to claim 28, wherein the stop means further comprises a gear and an encoder, wherein the common shaft is connected by the gear to the encoder.

* * * * *